US010392922B2

(12) United States Patent
Anisur Rahman et al.

(10) Patent No.: US 10,392,922 B2
(45) Date of Patent: Aug. 27, 2019

(54) MEASURING INTER-RESERVOIR CROSS FLOW RATE BETWEEN ADJACENT RESERVOIR LAYERS FROM TRANSIENT PRESSURE TESTS

(71) Applicant: Saudi Arabian Oil Company, Dhahran (SA)

(72) Inventors: Noor M. Anisur Rahman, Dhahran (SA); Hasan A. Nooruddin, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 781 days.

(21) Appl. No.: 14/595,299

(22) Filed: Jan. 13, 2015

(65) Prior Publication Data

US 2016/0201452 A1 Jul. 14, 2016

(51) Int. Cl.
*E21B 47/06* (2012.01)
*E21B 47/10* (2012.01)
*E21B 49/00* (2006.01)

(52) U.S. Cl.
CPC ..... *E21B 47/06* (2013.01); *E21B 47/10* (2013.01); *E21B 49/008* (2013.01)

(58) Field of Classification Search
None
See application file for complete search history.

(56) References Cited

U.S. PATENT DOCUMENTS 3,246,145 A 4/1966 Higgins
3,905,226 A 9/1975 Nicolas
4,215,567 A 8/1980 Vlcek
4,799,157 A 1/1989 Kuck et al.
4,803,873 A * 2/1989 Ehlig-Economides ..... E21B 47/06 73/152.31
4,969,130 A 11/1990 Wason et al.
5,305,209 A 4/1994 Stein et al.
(Continued)

FOREIGN PATENT DOCUMENTS

WO 2011019565 A2 2/2011

OTHER PUBLICATIONS

Partial Search Report for related PCT application PCT/US2016/013147 dated Apr. 26, 2016.
(Continued)

*Primary Examiner* — Alexander Satanovsky
*Assistant Examiner* — Brent A. Fairbanks
(74) *Attorney, Agent, or Firm* — Bracewell LLP; Constance G. Rhebergen; Albert B. Kimball, Jr.

(57) ABSTRACT

A measure of inter-reservoir cross flow rate between adjacent reservoir layers which are productive of hydrocarbons is determined. With passage of time, pressure differentials between reservoir layers can grow due to continuous production from an active layer. In addition, the flow area between an active layer and adjacent layers can grow with time for a given reservoir system. These changing pressure and flow conditions with time can contribute to substantial amounts of cross flow rates, which need to be accounted for when characterizing the commercial producibility of the active layer. The inter-reservoir cross flow rate is based on a measure of specific permeability and of cross flow rate within a reservoir layer which is obtained from pressure transient tests of the reservoir formations.

13 Claims, 6 Drawing Sheets

(56) References Cited

U.S. PATENT DOCUMENTS

| | | | | |
|---|---|---|---|---|
| 5,548,563 | A | 8/1996 | Slevinsky | |
| 5,586,082 | A | 12/1996 | Anderson et al. | |
| 5,730,219 | A | 3/1998 | Tubel et al. | |
| 5,787,050 | A | 7/1998 | Slevinsky | |
| 5,803,167 | A | 9/1998 | Bussear et al. | |
| 5,829,520 | A | 11/1998 | Johnson | |
| 5,975,204 | A | 11/1999 | Tubel et al. | |
| 6,840,317 | B2 | 1/2005 | Hirsch et al. | |
| 6,898,986 | B2 | 5/2005 | Daniel et al. | |
| 6,980,940 | B1 | 12/2005 | Gurpinar et al. | |
| 7,089,167 | B2 | 8/2006 | Poe | |
| 7,240,568 | B2 | 7/2007 | Atkinson | |
| 7,293,471 | B2 | 11/2007 | Lund Bo et al. | |
| 7,369,979 | B1 | 5/2008 | Spivey | |
| 7,389,185 | B2 | 6/2008 | Craig | |
| 7,580,797 | B2 | 8/2009 | Akram et al. | |
| 7,708,086 | B2 | 5/2010 | Witte | |
| 7,774,140 | B2 | 8/2010 | Craig | |
| 8,065,923 | B2 | 11/2011 | Duhanyan et al. | |
| 8,244,509 | B2 | 8/2012 | Banerjee et al. | |
| 8,275,593 | B2 | 9/2012 | Zhao | |
| 8,437,997 | B2 | 5/2013 | Meurer et al. | |
| 8,473,268 | B2 | 6/2013 | Benish et al. | |
| 8,620,611 | B2 | 12/2013 | Ong | |
| 8,620,636 | B2 | 12/2013 | Zhan et al. | |
| 8,781,747 | B2 | 7/2014 | Ziauddin | |
| 8,793,110 | B2 | 7/2014 | Myers et al. | |
| 8,793,112 | B2 | 7/2014 | Levitan | |
| 9,068,872 | B2 | 6/2015 | Gysling | |
| 9,085,966 | B2 | 7/2015 | Rahman | |
| 9,261,869 | B2 | 2/2016 | Cheng et al. | |
| 9,367,653 | B2 | 6/2016 | Madasu et al. | |
| 9,417,970 | B2 | 8/2016 | Fulton et al. | |
| 9,513,241 | B2 | 12/2016 | Whittaker | |
| 9,569,521 | B2 | 2/2017 | Crafton | |
| 9,617,833 | B2 | 4/2017 | Madasu et al. | |
| 9,626,466 | B2 | 4/2017 | Yang et al. | |
| 2002/0043370 | A1* | 4/2002 | Poe | E21B 43/14 166/250.07 |
| 2002/0189337 | A1 | 12/2002 | Maute | |
| 2008/0210470 | A1* | 9/2008 | Stewart | E21B 47/06 175/48 |
| 2009/0126475 | A1 | 5/2009 | Zhang et al. | |
| 2009/0308601 | A1 | 12/2009 | Poe, Jr. et al. | |
| 2010/0082258 | A1 | 4/2010 | Wang | |
| 2010/0224361 | A1 | 9/2010 | Pope et al. | |
| 2011/0015909 | A1 | 1/2011 | Zhao | |
| 2011/0040536 | A1* | 2/2011 | Levitan | E21B 49/00 703/2 |
| 2011/0191029 | A1 | 8/2011 | Jalali et al. | |
| 2012/0018167 | A1 | 1/2012 | Konopczynski et al. | |
| 2013/0080128 | A1 | 3/2013 | Yang | |
| 2013/0186688 | A1 | 7/2013 | Rasmus et al. | |
| 2013/0205886 | A1 | 8/2013 | Hegeman et al. | |
| 2013/0231867 | A1 | 9/2013 | Lin et al. | |
| 2013/0245952 | A1 | 9/2013 | Lin et al. | |
| 2014/0083687 | A1 | 3/2014 | Poe et al. | |
| 2014/0257775 | A1 | 9/2014 | Levitan | |
| 2015/0233233 | A1 | 8/2015 | Rahman | |
| 2015/0276970 | A1 | 10/2015 | Wu et al. | |
| 2016/0061020 | A1 | 3/2016 | Sayarpour | |
| 2016/0177679 | A1 | 6/2016 | Zhang et al. | |
| 2016/0178799 | A1 | 6/2016 | Sayarpour et al. | |
| 2016/0201452 | A1 | 7/2016 | Rahman et al. | |
| 2016/0208599 | A1 | 7/2016 | Rahman et al. | |

OTHER PUBLICATIONS

Gao Chengtai, "The Cross-flow Behavior and the determination of Reservoir Parameters by Drawdown Tests in Multilayer Reservoirs", Society of Petroleum Engineers, 1983, pp. 1-31, SPE 12580.

International Search Report for corresponding PCT application PCT/US2016/013147 dated Jul. 4, 2016.

Anbarchi et al., "Determination of Front Locations in a Multilayer Composite Reservoir", The 64th Annual Technical Conference and Exhibition of the Society of Petroleum Engineers held in Texas, 1989, pp. 285-296, SPE19799.

Cheng-Tai, "Single-Phase Fluid Flow in a Stratified Porous Medium With Crossflow", Society of Petroleum of Engineers Journal, 1984, pp. 97-106, SPE of AIME.

Ehlig-Economides et al., "A New Test for Determination of Individual Layer Properties in a Multilayered Reservoir", SPE Formation Evaluation, 1987, pp. 261-283, SPE14167.

Rahman et al., "Profiling Pressure—Derivative Values—A New, Innovative Way to Estimate the Radii of Investigation in Heterogeneous Reservoir Systems", SPE Middle East Oil & Gas Show & Exhibition, Manama, Bahrain, Mar. 10-13, 2013, pp. 1-12, SPE164217.

Stehfest, "Algorithms 368", Communications of the ACM, Jan. 1970, pp. 47-49. vol. 13, No. 1.

Al-Mutairi et al., "Fully Integrated Approach Using Temperature Measurements to Describe Complex Reservoirs: Case Study from Saudi Arabia", SPE Annual Technical Conference and Exhibition held in New Orleans Louisiana, 2013, pp. 1-13, SPE 166159.

Chu et al., "Pressure Transient Analysis of Two-Phase Flow Problems", SPE Formation Evaluation, 1986, pp. 151-164, Society of Petroleum Engineers.

International Search Report and Written Opinion for related PCT application PCT/US2016/014260 dated Jun. 13, 2016.

International Search Report and Written Opinion for related PCT application PCTUS2016/016330 dated Jun. 7, 2016.

Kamal et al., "Pressure Transient Testing Under Multiphase Flow Conditions", SPE Middle East Oil and Gas Show and Conference held in Manama Bahrain, 2011, pp. 1-10, SPE 141572.

Zheng et al., "New Approaches for Analyzing Transient Pressure from Oil and Water Two-Phase Flowing Reservoir", 2009 Kuwait International Petroleum Conference and Exhibition, 2009, pp. 1-25, Society of Petroleum Engineers.

* cited by examiner

MEASURING INTER-RESERVOIR CROSS FLOW RATE BETWEEN ADJACENT RESERVOIR LAYERS FROM TRANSIENT PRESSURE TESTS

BACKGROUND OF THE INVENTION

1. Field of the Invention

The present invention relates to pressure transient testing of producing hydrocarbon (oil and gas) reservoirs, and more particularly to measuring inter-reservoir cross flow rates between adjacent reservoir layers in connection with such pressure transient testing.

2. Description of the Related Art

Pressure transient tests are run on most wells in newly discovered and already producing hydrocarbon reservoirs. The results of such tests become a fundamental basis of assessing any future commercial producibility of the hydrocarbon (oil and gas) reservoirs, which includes important details such as economic forecasts based on predicted production rates, reserve assessments, and plans for development of infrastructure to produce and transport the hydrocarbons to markets and consumers.

During transient tests, both the production rates of fluids at surface and the pressures at downhole conditions are measured with time. Fluid samples are also collected and analyzed later in the laboratory for determining the engineering properties. The test data is analyzed in conjunction with fluid properties to characterize the reservoirs. Such an analysis includes comparing the test data with the predicted or synthetic response of a conceptual model of the actual reservoir. It is important to utilize a realistic model of the reservoir for predicting its future commercial producibility.

Transient tests are performed on new, exploratory and development wells to assess the reservoir productivity in commercial scale. Reservoir permeability and/or mobility, formation damage parameter in terms of skin factors, reservoir pressure, reservoir size and shape, locations of geological features or boundaries are important parameters that are usually determined through such tests. To ascertain accuracy of the reservoir parameters, often individual reservoir layers are tested separately. There are often adjacent reservoir layers to an active layer where wells are drilled through and produced from.

These adjacent layers are frequently separated from the active layer through what are known as tight streaks. Tight streaks are formed of semi-permeable, non-reservoir strata whose thicknesses can vary from a few inches to few hundred feet. Hence, during production from one layer (active layer), the fluid from an adjacent layer can migrate to the producing (active) layer through the tight streaks in the reservoir. With time, the pressure differential between the active and the adjacent layer can grow due to continuous production from the active layer. In addition, the flow area between the active and the adjacent layers can grow with time for a given reservoir system. These two changing conditions with time can contribute to substantial amounts of crossflow rates. Crossflow of fluid from one layer to the other within the reservoir complicates the assessment of the commercial producibility of the active layer.

Failure to account for crossflow between adjacent layers in the reservoir may mislead regarding the source of produced fluids and may thus provide unrealistic results from transient tests, where stakes are high. Transient tests provide the characteristic parameters of the reservoir that are acquired under a dynamic condition, which resembles an actual producing condition of a well.

During pressure transient tests, reservoir permeability and/or mobility, formation damage parameter in terms of skin factors, reservoir pressure, reservoir size and shape, locations of geological features or boundaries are important parameters that are usually determined through such tests. To ascertain accuracy of the reservoir parameters, often individual reservoir layers located at different vertical depths are tested separately. The layers are usually separated by semi-permeable or impermeable, non-reservoir strata whose thicknesses can vary from a few inches to few hundred feet. However, as mentioned, there are often adjacent reservoir layers to an active layer which are separated from the active layer through what are known as semi-permeable tight streaks.

In evaluating the productive capability of a subsurface reservoir layer, a test known as a transient pressure test is conducted for the layer under investigation. Sometimes, fluid from an adjacent layer can contribute to the total production from the active layer. For maximizing the hydrocarbon recovery from reservoirs under such a production arrangement, the operator of the oil or gas field needs to know the producibility of individual reservoir layers. The flow from adjacent layers interferes with accurate layer flow measurement. Such interference can cause an overestimation of the producibility of the layer under investigation. Failure to gain this a priori knowledge may cause loss of hydrocarbons from some reservoir layers due to diversion of this fluid from one reservoir layer to another layer instead of flowing towards the wellbore during production, or even shut-in.

SUMMARY OF THE INVENTION

Briefly, the present invention provides a new and improved computer implemented method of determining a measure of inter-reservoir crossflow rate between adjacent formation layers of a subsurface reservoir during a pressure transient test of a first of the adjacent reservoir layers. The computer implemented obtains a test measure of well pressure during the pressure transient test of the first layer, and also subsequently obtains a test pressure derivative of well pressure at sampled instants of measurement. Progressively a more realistic value of specific permeability between the adjacent layers is received, and a set of model wellbore flowing pressures. A corresponding set of model pressure derivative is also determined based on the test pressure and the test pressure derivative and the estimated value of specific permeability between the adjacent layers. A model inter-reservoir crossflow rate is determined based on the estimated value of specific permeability between the adjacent layers. The model wellbore flowing pressure is compared with the test measure of well pressure, and the model pressure derivative is compared with the test pressure derivative. If the postulated measures and test measures match within an acceptable degree of a preset criterion value, the estimated value of specific permeability between the adjacent layers, the model inter-reservoir crossflow between the adjacent layers, the model wellbore flowing pressure, and the model pressure derivative are stored. If not, the estimated value of specific permeability between the adjacent layers is adjusted, and the steps of determining a model wellbore flow pressure, determining a model pressure derivative, determining a model inter-reservoir crossflow rate and comparing based on the adjusted estimated value of specific permeability between the adjacent layers are repeated.

The present invention further provides a new and improved data processing system for determining a measure of inter-reservoir crossflow rate between adjacent formation layers through the tight streaks of a subsurface reservoir during a pressure transient test of a first of the adjacent reservoir layers. The data processing system includes a processor which obtains a test measure of well pressure during the pressure transient test of the first layer, and also obtains a test pressure derivative of measured or test well pressure at sampled instants of measurement during the pressure transient test of the first layer. The processor receives an estimated value of specific permeability between the adjacent layers, and determines a model wellbore flowing pressure based on the test measure of well pressure and the estimated value of specific permeability between the adjacent layers. The processor further determines a model pressure derivative based on the test pressure derivative and the estimated value of specific permeability between the adjacent layers, and determines a model inter-reservoir crossflow rate based on the estimated value of specific permeability between the adjacent layers. The processor compares the model wellbore flowing pressure with the test measure of well pressure, and compares the model pressure derivative with the test pressure derivative. If the postulated measures and test measures match within an acceptable degree of a preset criterion value, the processor stores the estimated value of specific permeability between the adjacent layers, the model inter-reservoir crossflow between the adjacent layers, the model wellbore flowing pressure, and the model pressure derivative. If not, the processor adjusts the estimated value of specific permeability between the adjacent layers, and repeats the steps of determining a model wellbore flow pressure, determining a model pressure derivative, determining a model inter-reservoir crossflow rate and comparing based on the adjusted estimated value of specific permeability between the adjacent layers. The data processing system also includes a memory storing the estimated value of specific permeability between the adjacent layers, the model inter-reservoir crossflow between the adjacent layers, the model wellbore flowing pressure, and the model pressure derivative.

The present invention further provides a new and improved data storage device which has stored in a non-transitory computer readable medium computer operable instructions for causing a data processing system to determining a measure of inter-reservoir crossflow rate between adjacent formation layers of a subsurface reservoir during a pressure transient test of a first of the adjacent reservoir layers. The instructions cause the data processing system to obtain a test measure of well pressure during the pressure transient test of the first layer, and also obtain a test pressure derivative of well pressure at sampled instants of measurement during the pressure transient test of the first layer. The instructions cause the data processing system to receive an estimated value of specific permeability between the adjacent layers, and determine a model wellbore flowing pressure based on the estimated value of specific permeability between the adjacent layers. The instructions cause the data processing system to further determine a model pressure derivative based on the test pressure derivative and the estimated value of specific permeability between the adjacent layers, and determine a model inter-reservoir crossflow rate based on the estimated value of specific permeability between the adjacent layers. The instructions cause the data processing system to compare the model wellbore flowing pressure with the test measure of well pressure, and compare the model pressure derivative with the test pressure derivative. If the postulated measures and test measures match within an acceptable degree of a preset criterion value, the data processing system is instructed to store the estimated value of specific permeability between the adjacent layers, the model inter-reservoir crossflow between the adjacent layers, the model wellbore flowing pressure, and the model pressure derivative. If not, the data processing system is instructed to adjust the estimated value of specific permeability between the adjacent layers, and repeat the steps of determining a model wellbore flow pressure, determining a model pressure derivative, determining a model inter-reservoir crossflow rate and comparing based on the adjusted estimated value of specific permeability between the adjacent layers. The instructions cause the data processing system to also store in memory the estimated value of specific permeability between the adjacent layers, the model inter-reservoir crossflow between the adjacent layers, the model wellbore flowing pressure, and the model pressure derivative.

DETAILED DESCRIPTION OF THE PREFERRED EMBODIMENTS

Figure 1:
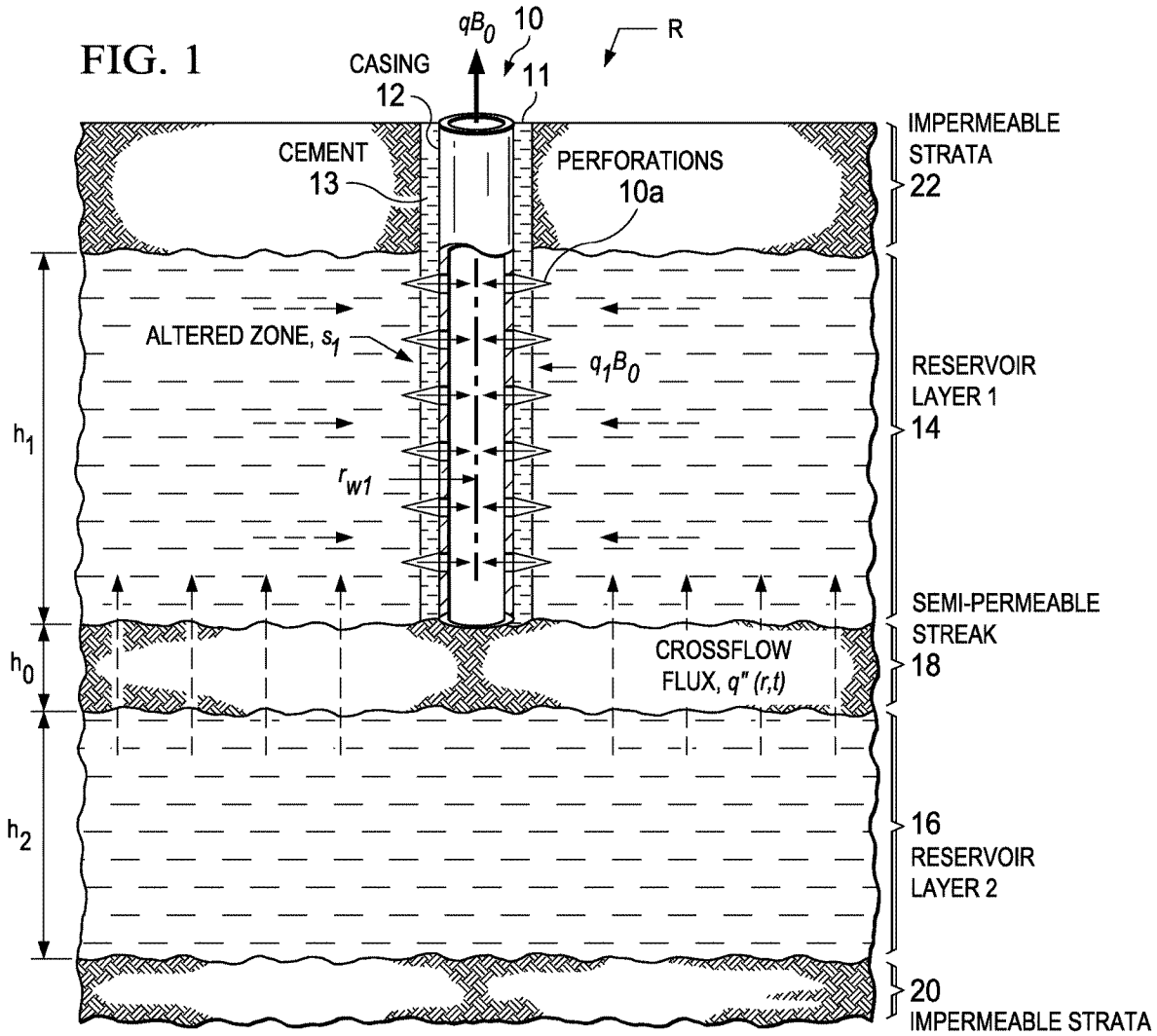
FIG. 1 is a schematic view, taken in cross-section, of a producing well in the earth in flow communication with an active subsurface reservoir layer separated from another lower adjacent reservoir layer by a semi-permeable earthen streak.

In the drawings, FIG. 1 represents schematically a cross-sectional view of a subsurface reservoir R into which a hydrocarbon producing well 10 in a well bore 11 which has been drilled extending through subsurface formations. The well 10 is completed in the reservoir R by perforations 10*a* in a production casing string 12 and casing cement 13. The well 10 is completed only in a primary reservoir layer 14, referred to as Layer 1, of the reservoir R. A second adjacent layer 16, referred to as Layer 2, can communicate and contribute fluid to Layer 1 through reservoir crossflow only, since it has not been completed for production. The reservoir layers 14 and 16 are separated by a semi-permeable rock 18, known as a tight streak. There is thus an opportunity for outflux of some fluid from the adjacent layer 16 (Layer 2) to transmit to the active or primary reservoir layer 14 (Layer 1), during testing operations, or even simply during any normal producing conditions.

The outflux from Layer 2 to Layer 1 can occur due to the pressure differential between layers 16 and 14 caused by the production from Layer 1. An upper impermeable layer 22 is located above layer 14, and a lower impermeable layer 20 is located below layer 16. For the purposes of the present invention, no other kinds of crossflow are considered through the wellbore 10 or behind the casing 12. The full probable fluid influx to Layer 1 from Layer 2 is taking place only within the reservoir R.

If neither of the layers 14 or 16 are subject to any production, the pressures in individual adjacent layers 14 and 16 stay hydrodynamically balanced, and there cannot be any crossflow of fluids between these adjacent reservoir layers. Since layer 14 (or Layer 1), is completed and subject to production as shown in FIG. 1, the pressure in Layer 1 declines, causing a pressure differential across the semi-permeable streak 18. This pressure differential facilitates crossflow of fluids from Layer 2 at a higher pressure to Layer 1 at a lower pressure. With time the pressure differential may grow, and so may the common area of flow between adjacent layers 14 and 16. The present invention provides a systematic methodology to assess time-dependent rates of crossflow from transient pressure tests.

A pressure transient test is performed to characterize an individual reservoir layer while maintaining the production from this layer only. The results of performing transient tests on a particular reservoir layer become unreliable and misleading when another reservoir layer contributes to the production, due to the reasons explained above. The present invention permits reservoir engineers, reservoir analysts or other similarly interested persons to diagnose if there is additional fluid coming to a tested reservoir layer during pressure transient testing. If so, the engineer/analyst is able to estimate the amount of the additional flow rate joining the tested reservoir layer. Knowing these facts about subsurface flow conditions, the tested reservoir layer can be characterized accurately, including the amount of hydrocarbon reserves in the tested layer. Moreover, this information is also important in designing an effective water injection strategy in voidage replacement for an optimum reservoir management. When engineers/analysts have the estimates of crossflow rates as a function of time, they are able to determine the cumulative amounts of migrated fluids with time for material balance calculations or for record keeping purposes.

The present invention provides reservoir engineers, analysts and others interested with the ability to characterize the rate of crossflow from Layer 2 to Layer 1. As shown in FIG. 1, the specific permeability, X, between two adjacent layers and the flux between these layers are constituent parameters of estimating the crossflow rates.

The specific permeability, X, between the two adjacent layers 14 and 16 shown in FIG. 1 can be re resented or expressed as:

$$X = \frac{2k_{v0}k_{v1}k_{v2}}{2h_0k_{v1}k_{v2} + h_1k_{v0}k_{v2} + h_2k_{v0}k_{v1}} \tag{1}$$

The unit of X is md/ft, $k_{v0}$ is the average vertical permeability in md, and $h_0$ is the thickness in ft of the streak. Also, $k_{v1}$ and $k_{v2}$ are the vertical components of permeability in md, and $h_1$ and $h_2$ are the pay thicknesses in ft, of Layer 1 and Layer 2, respectively.

When at least one of the three vertical components of permeability is zero, the specific permeability, X, becomes zero. In such a case, there is no fluid transmission from Layer 2 to Layer 1, no matter what the differential pressure exists at a given point or time. The horizontal conductivity (or permeability) in the streak 18 located between Layer 1 and Layer 2 for the purposes of the present invention is considered to be negligible, with no capacity of any fluid storage. Also, the fluid properties (viscosity and formation volume factor) of both layers 14 and 16 are considered identical.

A specific permeability characterization similar to the one in Equation (1) was originally proposed for linear flow in stratified layers by Cheng-Tai [February 1964, Single-Phase Fluid Flow in a Stratified Porous Medium with Crossflow, Society of Petroleum Engineers Journal: 97-106]. In general, it is difficult to know all the components on the right-hand side of Equation (1) to estimate the value of X. Thus, one of the features provided with the present invention based on data from pressure transient tests is evaluation of an effective value of X in a layered-reservoir system. The value of estimating X permits estimation of the flux of crossflow, as will be described next.

Figure 2:
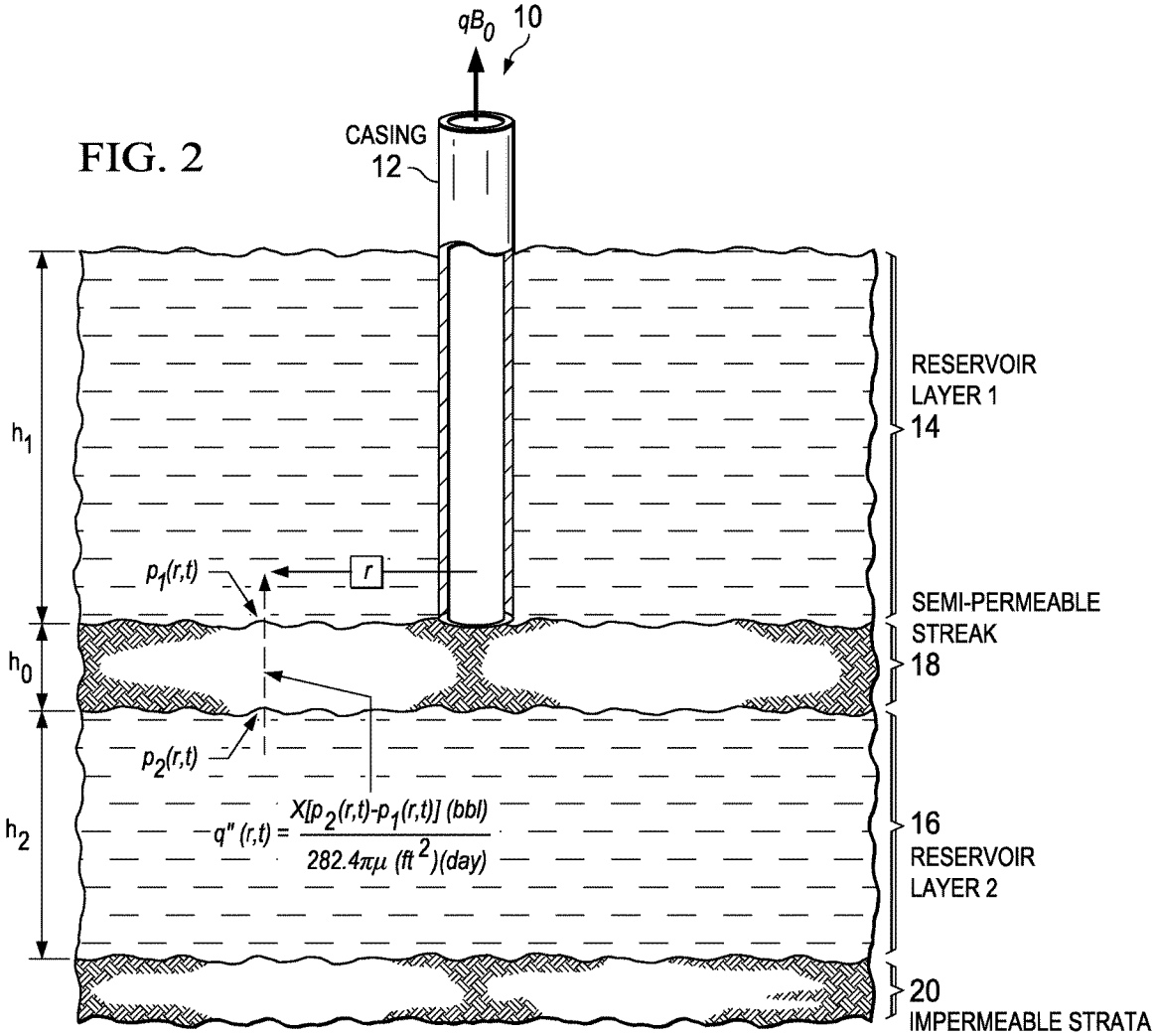
FIG. 2 is a schematic diagram illustrating crossflow rate per unit area and related parameters for inter-reservoir crossflow between the adjacent reservoir layers of FIG. 1.

Turning to FIG. 2, the well bore 10 and production casing 12 can be seen to extend from the earth surface through subsurface formations into producing or primary layer 14 of the reservoir R. The well bore 10 and production casing 12 do not extend into the layer 16 or the semi-permeable streak 18. The layer 14 has pay thickness $h_1$, the layer 16 has pay thickness $h_2$ and the semi-permeable streak has thickness $h_0$. In the absence of tight streaks between the two adjacent layers 14 and 16, $h_0$ has to be taken as zero in Equation (1). This case may still result in a non-zero value of X, which can allow for crossflow between the layers.

The flux (crossflow rate per unit area) at location A (FIG. 2) spaced a distance r from well bore 10 in the reservoir R and at a given time t is proportional to the pressure differential between pressure $p_2(r,t)$ in layer 16 and pressure $p_1(r,t)$ in layer 14 at the same location and time. The influx rate to Layer 1 from Layer 2 depends on the value of X, the extent of flow area and the value of pressure differential at a given time as illustrated in FIG. 2. The flux q" at that location and time in bbl/d/ft$^2$ can be expressed or estimated by the following equation:

$$q''(r,t) = \frac{X[p_2(r,t) - p_1(r,t)]}{282.4\pi\mu} \tag{2}$$

The flux expressed in Equation (2) is the basis of computing the crossflow rate from Layer 2 to Layer 1 at a given time as to be presented below in Equation (5) in Laplace domain.

With the present invention, an analytical solution to the pressure-transient behavior of a two-layer system subject to crossflow in the reservoir has been used to develop the procedure of calculating the crossflow rates. This analytical solution also provides type curves which help diagnose the existence of any such crossflow in the reservoir. Also this solution helps build accurate and representative models of subsurface flow based on actual data from pressure transient tests. The analytical solution is also enhanced to estimate the rate of crossflow from Layer 2 to Layer 1 at a given time. When in the description below reference is made to a model, this is a reference to the analytical solution, which provides a tangible understanding of the pressure behavior of the layered-reservoir system being dealt with.

Presentation of the Model

The equations expressing the physical relationships of layer crossflow from an analytical solution are expressed below. It is to be noted that all the equations presented here are in the system of US Oilfield units, and conversion to any another system of units may be readily performed and is contemplated within the present invention.

The effects of wellbore storage and skin factor in the producing well completed in the active layer are included. The pressures considered here are corrected to a datum depth. The rates are at the reservoir conditions, unless stated otherwise. The storage constant, C, in bbl/psi, takes care of the phenomenon if it exists, while the skin factor, $s_1$, is considered through the effective wellbore radius, $r_{wa1}$, having the actual wellbore radius of $r_{w1}$ as $$r_{wa1}=r_{w1}e^{-s1} \tag{3}$$

Subscripts 1 and 2 with reservoir well parameters in this context refer to physical locations of Layer 1 and Layer 2, respectively.

Set forth below are nomenclature and the major working equations of the analytical solution, also interchangeably referred to as the model, which are used in calculating pressures and crossflow rates between the layers. In this model, the well is considered to be producing at a constant rate of q STB/d, while the pressures, the pressure derivatives and the crossflow rates are observed. The Laplace transforms have been performed on the quantities which are time-dependent to make the original partial differential equations solvable. It is to be noted that the equations for the well flowing pressure ($p_{wf}$) and the crossflow rate ($q_2B_o$) are presented in the Laplace domain as $\overline{p}_{wf}$ and $\overline{q_2B_o}$, respectively. The values of these equations accordingly need to be inverted back to the time domain with the Stehfest algorithm [Stehfest, H., 1970, Algorithm 368: Numerical Inversion of Laplace Transforms. *Communications of ACM* 13(1): 47-49].

Nomenclature $B_o$ Formation volume factor of fluid in Layer 1 and Layer 2, bbl/STB $c_{t1}$, $c_{t2}$ Total system compressibility in Layer 1 and Layer 2, respectively, 1/psia C Wellbore storage constant, bbl/psia $F_1$, $F_2$ Term dominated by reservoir storage in Layer 1 and Layer 2, $$\frac{\varphi_1\mu h_1 c_{t1}}{0.0002637}$$

and, $$\frac{\varphi_2\mu h_2 c_{t2}}{0.0002637}$$

respectively, ft·cP/psia $h_0$ Thickness of streak separating Layer 1 from Layer 2, ft $h_1$, $h_2$ Pay thickness of Layer 1 and Layer 2, respectively, ft $k_{v0}$ Vertical permeability of streak between Layer 1 and Layer 2, md $k_1$, $k_2$ Permeability in the radial direction (horizontal) in Layer 1 and Layer 2, respectively, md $k_{v1}$, $k_{v2}$ Vertical permeability in Layer 1 and Layer 2, respectively, md $K_0(\ )$, $K_1(\ )$ Modified Bessel functions of the second kind of orders 0 and 1, respectively l Laplace transform parameter, 1/hr $p_0$ Initial reservoir pressure, psia $p_1(r, t)$ Pressure in Layer 1 as a function of space and time, psia $p_2(r, t)$ Pressure in Layer 2 as a function of space and time, psia $p_{wf}$ Wellbore flowing pressure (well is completed in Layer 1), psia $\overline{p}_{wf}$ Laplace transform of wellbore flowing pressure $p_{wf}$, psia·hr [The Laplace transform of this time-dependent variable makes it easier to obtain the solution to the problem.]

q Rate of production in standard conditions from wellbore, STB/d q" Flux of crossflow, defined in Equation (2), in bbl/d/ft$^2$ $qB_0$ Rate of production in reservoir conditions from wellbore, bbl/d $q_2$ Crossflow rate in standard conditions from Layer 2 to Layer 1, STB/d $q_2B_o$ Crossflow rate in reservoir conditions from Layer 2 to Layer 1, bbl/d $\overline{q_2B_o}$ Laplace transform of crossflow rate $q_2B_o$, bbl·hr/d [The Laplace transform of this time-dependent variable makes it easier to obtain the solution to the problem.]

$r_{wa1}$ Equivalent wellbore radius, ft $r_{w1}$ Physical wellbore radius, ft $s_1$ Skin factor in well completed in Layer 1 (this value can be negative, zero or positive)

t Elapsed time, hr

X Specific permeability between Layer 1 and Layer 2, defined in Equation (1), md/ft Y Derived parameter, defined in Equation (6), 1/ft$^2$ Z Derived parameter, defined in Equation (7), 1/ft$^4$ $\alpha_1$ Flow parameter in Layer 1, $$\frac{k_1 h_1 r_{w1}}{141.2\mu},$$

md·ft/cP $\beta_1$, $\beta_2$ Parameter in Layer 1 and Layer 2, defined in Equations (10) and (11), respectively, md·psia/cP $\phi_1$, $\phi_2$ Porosity of Layer 1 and Layer 2, respectively, fraction $\kappa_1$, $\kappa_2$ Flow capacity of Layer 1 and Layer 2, $k_1h_1$ and $k_2h_2$, respectively, md·ft $\sigma_1$, $\sigma_2$ Parameter of Layer 1 and Layer 2, defined by Equations (8) and (9), respectively, 1/ft μ Viscosity of fluid, cP Well Flowing Pressure at Tested Layer (Reservoir Layer 1):

$$\overline{p}_{wf} = \frac{p_0}{l} - \frac{qB_o\left\{K_0(\sigma_1 r_{wa1}) - \frac{\beta_1}{\beta_2}K_0(\sigma_2 r_{wa1})\right\}}{l\left[24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}\right]} \tag{4}$$

Crossflow Rate in Reservoir Conditions:

$$\overline{q_2 B_o} = \frac{qB_o X\left[\frac{(1-\beta_1)}{\sigma_1^2} - \frac{\beta_1(1-\beta_2)}{\beta_2\sigma_2^2}\right]}{141.2\mu l\left[24Cl\left\{K_0(\sigma_1 r_{wa1}) - \frac{\beta_1}{\beta_2}K_0(\sigma_2 r_{wa1})\right\} + \alpha_1\left\{\sigma_1 K_1(\sigma_1 r_{w1}) - \frac{\beta_1}{\beta_2}\sigma_2 K_1(\sigma_2 r_{w1})\right\}\right]} \quad (5)$$

Parameters Requiring Pre-Calculations for Equations (4) and (5):

$$Y = \frac{\kappa_1(X + F_2 l) + \kappa_2(X + F_1 l)}{\kappa_1\kappa_2} \quad (6)$$

$$Z = \frac{(X + F_2 l)(X + F_1 l) - X^2}{\kappa_1\kappa_2} \quad (7)$$

$$\sigma_1^2 = \frac{Y + \sqrt{Y^2 - 4Z}}{2} \quad (8)$$

$$\sigma_2^2 = \frac{Y - \sqrt{Y^2 - 4Z}}{2} \quad (9)$$

$$\beta_1 = -\frac{X}{\kappa_2\sigma_1^2 - X - F_2 l} \quad (10)$$

$$\beta_2 = -\frac{X}{\kappa_2\sigma_2^2 - X - F_2 l} \quad (11)$$

Steady-State Crossflow Rate:

$$q_2(t \to \infty)B_o = \frac{qB_o\kappa_2}{\kappa_1 + \kappa_2} \quad (12)$$

As mentioned earlier, processing computations for $p_{wf}$ and $q_2B_o$, using Equations (4) and (5), respectively, require employing the Stehfest algorithm (1970). Those skilled in the art should be able to perform this step without any difficulty. While calculating the wellbore flowing pressure, $p_{wf}$, with Equation (4), the corresponding pressure derivative $$\left(t\frac{dp_{wf}}{dt}\right)$$

is also calculated simultaneously before applying the Stehfest algorithm to both pressure and derivative. This methodology is described in Rahman and BinAkresh [2013, Paper SPE 164217 Profiling Pressure-Derivative Values]. It is also to be noted that Equation (12) provides the maximum possible crossflow rate between the two layers 14 and 16, which is likely to occur after a very long time of production from layer 14 (Layer 1).

Although the methodology described above and each of the equations presented above are described in the context of drawdown cases (when the well is in continuous production), the present invention is equally applicable to the buildup cases (when the well is shut-in following a period of production at a constant rate) through the use of the principle of superposition, which is a commonplace and conventional known practice commonly utilized by those skilled in the art in the petroleum industry.

A comprehensive methodology of determining well flowing pressures, pressure derivatives and crossflow rates from the above model and of estimating specific permeability between the layers, X, utilizing transient-test data through an iterative scheme is summarized in FIG. 3 below. A change in well pressure is defined as the difference between the initial reservoir, $p_0$, or the initial well flowing pressure, $p_{wf}$ (t=0), and the current well flowing pressure, $p_{wf}(t)$. Thus this change in well pressure should grow with time when the well is producing.

Figure 3:
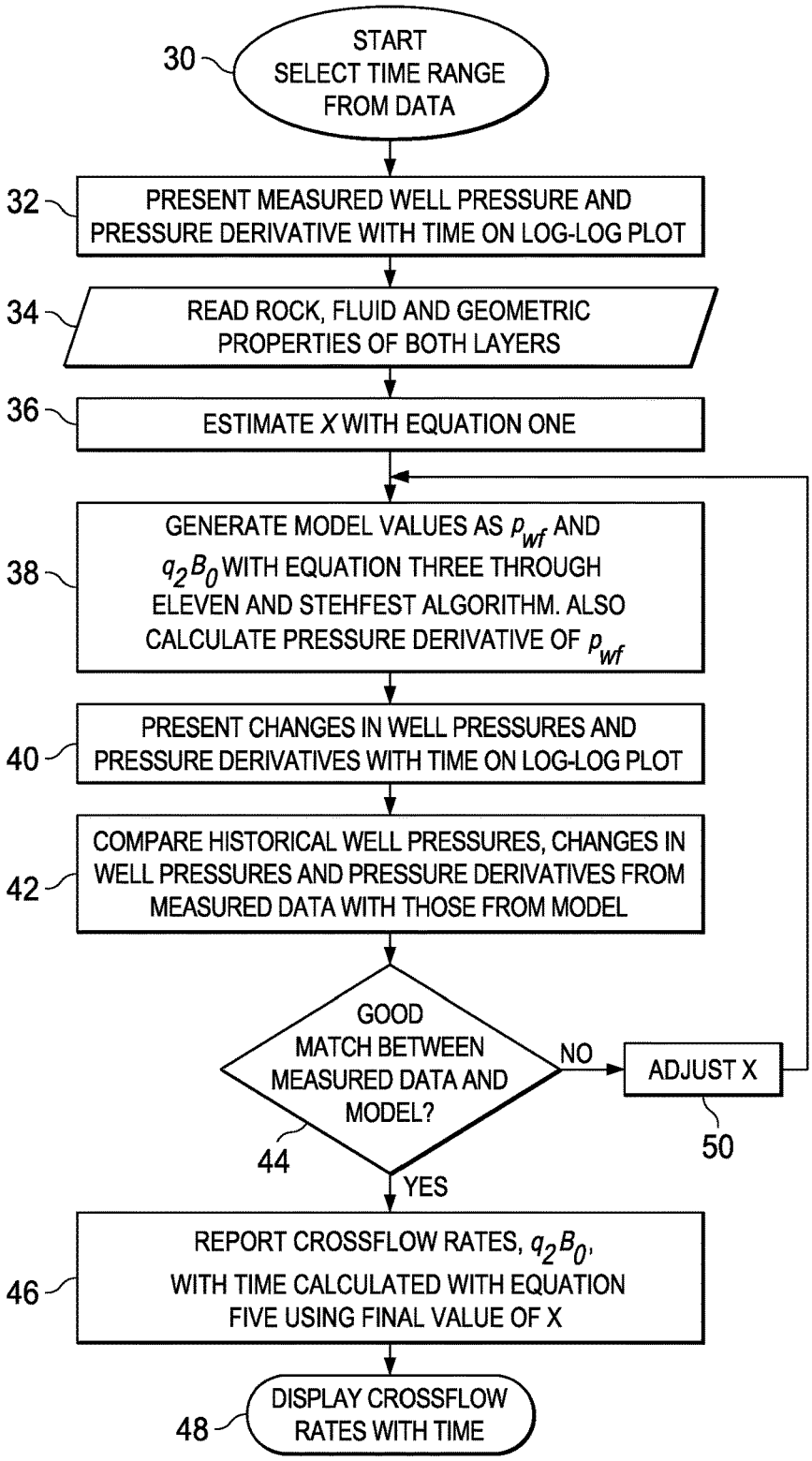
FIG. 3 is a functional block diagram of a flow chart of data processing steps for estimating specific permeability between adjacent reservoir layers according to the present invention.

A computer implemented process according to the present invention of determining well pressures, pressure derivative and of estimating of inter-reservoir crossflow rates between adjacent layers with time from the model and by utilizing pressure transient-test data through an iterative scheme is illustrated schematically in a flow chart F in FIG. 3.

The flow chart F (FIG. 3) illustrates the structure of the logic of the present invention as embodied in computer program software. Those skilled in the art will appreciate that the flow charts illustrate the structures of computer program code elements including logic circuits on an integrated circuit that function according to this invention. Manifestly, the invention is practiced in its essential embodiment by a machine component that renders the program code elements in a form that instructs a digital processing apparatus (that is, a computer) to perform a sequence of data transformation or processing steps corresponding to those shown.

FIG. 3 illustrates schematically a preferred sequence of steps of a process for analyzing a subsurface reservoir of interest to determine measures of inter-reservoir crossflow rates between adjacent, such as to layer 14 being pressure transient tested from an adjacent layer 16.

As shown at step 30, processing according to the present invention begins with a time range being selected from the pressure and time data obtained during pressure transient test of a layer of interest such as layer 12 (Reservoir Layer 1). The model and its structure has been described above in terms of equations in the Laplace domain. During step 32, the measured well pressure $p_{wf}$ and pressure derivative $$\left(t\frac{dp_{wf}}{dt}\right)$$

are formatted in a form for storage and subsequent display in log-log plots, and are available for output display as diagnostic plots by data processing system D (FIG. 4) in such format. As a result of step 32, reservoir engineers and other users are able to diagnose if there is any evidence of crossflow between the adjacent layers. This is done by utilizing the procedure described below relating to diagnostic plots. The present invention is particularly relevant if any crossflow between the adjacent layers has been diagnosed.

During step 34, the petrophysical and reservoir data of both reservoir layers 14 and 16 are gathered. The model is run with the petrophysical and reservoir parameters for different plausible values of specific permeability between the layers, X. Usually porosity, fluid saturation and pay thickness can be extracted from the interpretation of the open-hole log of the subject well 10. Viscosity, compressibility and formation volume factors are typically available and found from fluid analysis reports. Permeability in an individual producing layer such as layer 14 can be found from the previous or the current pressure transient test of that layer.

By following step 32, the crossflow between the adjacent layers has been diagnosed, and this requires a non-zero, positive value to X as the first estimate. During step 36, an initial measure or estimate of the specific permeability, X, between the two adjacent layers is determined based on the relationship expressed in Equation (1) and based on the input data. Remaining steps in the flow chart F are to demonstrate on how to obtain more reliable values of X by trial and error.

During step 38, model values of well flowing pressure ($p_{wf}$), and crossflow rate ($q_2B_o$) are determined using the methodology described with Equations (3) through (11) and the Stehfest algorithm mentioned above. The pressure derivative $$\left(t\frac{dp_{wf}}{dt}\right)$$

of the model well pressure $p_{wf}$ is also determined during step 38 in the manner described above. The respective pressure and derivative plots are made ready to compare with the actual pressure and derivative of data from actual transient tests. The model values determined during step 38 are formatted in a form for storage and subsequent display in log-log plots, and are available in that format for output display as indicated at step 40 by data processing system D.

During step 42, the model values of well pressure $p_{wf}$ and the corresponding pressure derivative $$\left(t\frac{dp_{wf}}{dt}\right)$$

determined during step 38 are evaluated by determining the differences of the model values from the historical (measured or test) well pressures, changes in pressures and pressure derivatives values obtained during step 32. The results of the differences observed in step 42 between the model and the data can signify how valid the value of X as estimated during step 36 is.

The present value of the specific permeability, X, is then modified or refined as part of an iterative scheme according to the present invention to obtain a match between the model values of pressure and derivative with the test values of pressure and derivative, respectively. Due to uncertainty in some of or all the components in Equation 1, particularly the components of vertical permeability, for example, one cannot be sure of the initial estimates of X Thus, iteration on this parameter with the model-generated responses is performed to determine a more reasonable value of X in each subsequent step.

During step 44, the determined results of step 42 are compared with a specified criterion value. It has also been presented in step 42 that comparisons are required for each of well pressure and pressure derivative. Due to a lack of access to any measured crossflow rates between the two adjacent layers, the analyst relies on the crossflow rates from the model only. So a good estimate of the value X will ensure a good values of crossflow rates. If the values obtained during step 38 which are compared during steps 42 and 44 indicate that the model values being compared correspond within a specified acceptable degree of criterion with historical data 44, an acceptable value of crossflow rate ($q_2B_o$) between the layers 14 and 16 is indicated.

It is a common practice to leave the criteria of determining the closeness between the measured and the model values up to the experience and judgment of the user analyst or engineer. Such a process involves minimizing the standard deviation between the measured pressures and the model pressures to a preset criterion value (for example, 0.1). Once such a preset criterion value is satisfied in step 44, the user is thus satisfied to call the model as the reasonably well matched one.

Figure 4:
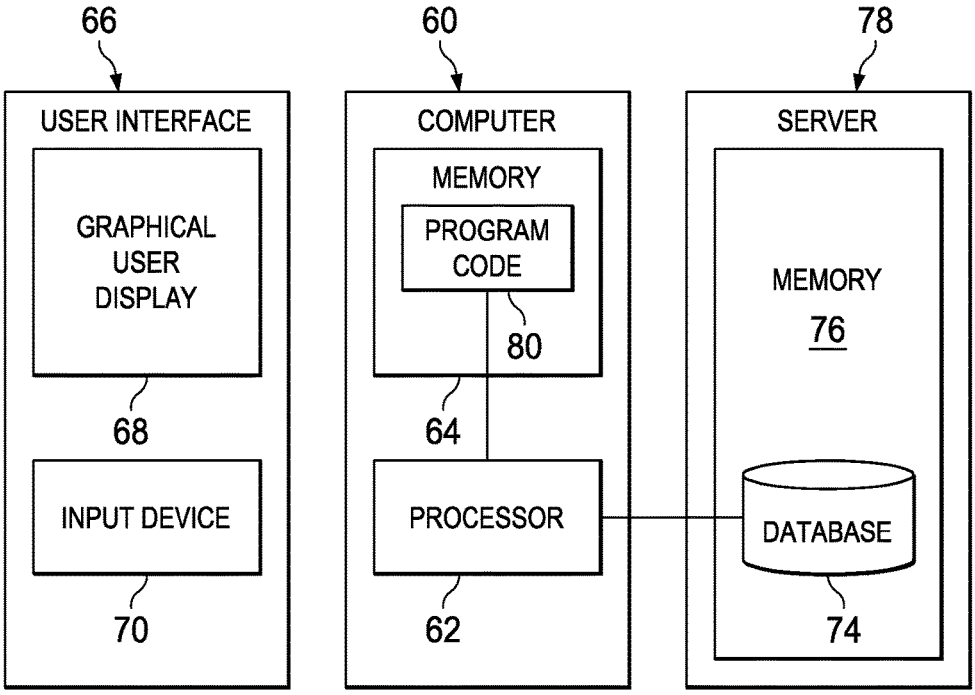
FIG. 4 is a schematic diagram of a data processing system for measuring inter-reservoir cross flow rate between adjacent reservoir layers according to the present invention.

As represented at step 46, the acceptable value of crossflow rate ($q_2B_o$) is determined according to Equation (5) based on the value of specific permeability, X, used in the processing. As indicated at step 48, the determined crossflow rates with time are displayed with the data processing system D (FIG. 4). Once a reasonable match has been found between the model and the test data in steps 42 and 44, the value of the specific permeability, X, becomes a characteristic parameter determined for the layers 14 and 16 according to the present invention.

The specific permeability, X, thus determined can henceforth be used to estimate the crossflow rates from Layer 2 to Layer 1. Although the crossflow rates as a function of time are usually the output of the model in steps 38, 40 and 42 for the respective value(s) of X, the final set of crossflow rates ($q_2B_o$) following an acceptable match with the test data determined in step 44 should be used for further studies or making decisions.

If the results of step 44 indicate an unacceptable accuracy between the model and the measured or test values being compared, the value of specific permeability, A, is adjusted during step 50 and processing returns to step 38 for processing based on the adjusted value of specific permeability, X. Processing continues for further iterations until during step 44 an acceptable value of crossflow rate ($q_2B_o$) is indicated.

As illustrated in FIG. 4, the data processing system D includes a computer 60 having a processor 62 and memory 64 coupled to the processor 62 to store operating instructions, control information and database records therein. The data processing system D may be a multicore processor with nodes such as those from Intel Corporation or Advanced Micro Devices (AMD), an HPC Linux cluster computer or a mainframe computer of any conventional type of suitable processing capacity such as those available from International Business Machines (IBM) of Armonk, N.Y. or other source. The data processing system D may also be a computer of any conventional type of suitable processing capacity, such as a personal computer, laptop computer, or any other suitable processing apparatus. It should thus be understood that a number of commercially available data processing systems and types of computers may be used for this purpose.

The processor 62 is, however, typically in the form of a personal computer having a user interface 66 and an output display 68 for displaying output data or records of processing of force measurements performed according to the present invention. The output display 68 includes components such as a printer and an output display screen capable of providing printed output information or visible displays in the form of graphs, data sheets, graphical images, data plots and the like as output records or images.

The user interface 66 of computer 60 also includes a suitable user input device or input/output control unit 70 to provide a user access to control or access information and database records and operate the computer 60.

Data processing system D further includes a database 74 stored in memory, which may be internal memory 64, or an external, networked, or non-networked memory as indicated at 76 in an associated database server 78. The database 74 also contains various data including the time and pressure data obtained during pressure transient testing of the layer under analysis, as well as the rock, fluid and geometric properties of layers 14 and 16, and the casing, annulus and other formation properties, physical constants, parameters, data measurements identified above with respect to FIGS. 1 and 2 and the Nomenclature table.

The data processing system D includes program code 80 stored in a data storage device, such as memory 64 of the computer 60. The program code 80, according to the present invention is in the form of computer operable instructions causing the data processor 62 to perform the methodology of determining measures of well pressures, pressure derivative and of estimating of inter-reservoir crossflow rates ($q_2B_o$) between adjacent layers from the above model by utilizing pressure transient-test data, and specific permeability, X, between the layers.

It should be noted that program code 80 may be in the form of microcode, programs, routines, or symbolic computer operable languages that provide a specific set of ordered operations that control the functioning of the data processing system D and direct its operation. The instructions of program code 80 may be stored in non-transitory memory 64 of the computer 60, or on computer diskette, magnetic tape, conventional hard disk drive, electronic read-only memory, optical storage device, or other appropriate data storage device having a computer usable medium stored thereon. Program code 80 may also be contained on a data storage device such as server 68 as a non-transitory computer readable medium, as shown.

Figure 5:
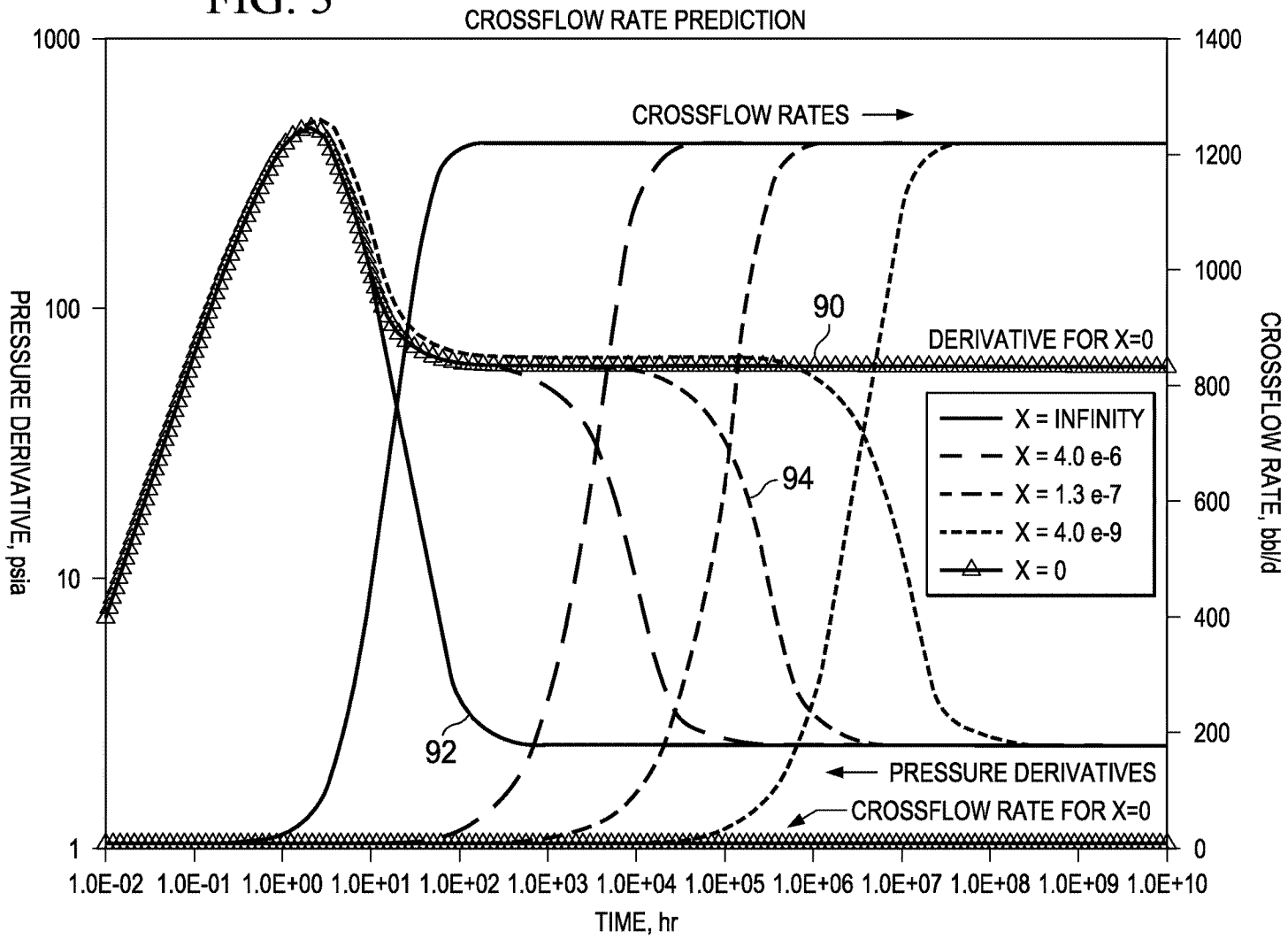
FIG. 5 is a plot showing the effects of specific permeability on pressure derivative from pressure transient testing and on inter-reservoir cross flow rate between layers.

The processor 62 of the computer 60 accesses the pressure transient testing data and other input data measurements as described above to perform the logic of the present invention, which may be executed by the processor 62 as a series of computer-executable instructions. The stored computer operable instructions cause the data processor computer 60 to determine measures of inter-reservoir crossflow rates ($q_2B_o$) between adjacent layers and specific permeability, X, between the layers in the manner described above and shown in FIG. 3. Results of such processing are then available on output display 68. FIG. 5 is an example display of such result.

Having considered the crossflow ($q_2B_o$) between the layers in the reservoir, it is now possible to characterize the tested reservoir layer 14 (Layer 1) accurately. Subsequent reserve and voidage replacement calculations should be reasonably accurate when an accurate measure of crossflow is made available according to the present invention.

Diagnostic Plots

Using the physical relationships governed by the Equations presented earlier, diagnostic plots are generated in accordance with the present invention to ascertain if there is any crossflow between the two adjacent layers. FIG. 5 presents a set of such diagnostic plots which shows the effect of the specific permeability, X, on the pressure derivative and on the respective crossflow rates ($q_2B_o$) from Layer 2 to Layer 1. A zero value to X means that the Layer 2 is isolated from Layer 1 in the reservoir region, and only Layer 1 can contribute to production. As shown in FIG. 1, the well 10 is completed across Layer 1 only.

Thus, the case of X=0 md/ft replicates nothing but a situation of the well producing from a single-layer reservoir. The case of specific permeability of limitless (infinite) measure, or X=∞, replicates very high vertical permeability in both layers 14 and 16 and in the streak 18, which is equivalent to a partially-completed layered-reservoir system with high vertical permeability. Thus, the case of X=0 md/ft and the case of X=∞ represent the two possible extreme cases for values of the specific permeability. Most practical cases should result in values for X between the two extreme cases, for example with X=4.0 e-9, 1.3 e-9 and 4.0 e-9 md/ft. Using the methodology of FIG. 3 as described above, diagnostic plots as FIG. 5 can be constructed from the model with a view to matching the actual data (well flowing pressure and its derivative) from pressure transient tests.

As shown in FIG. 5, for the two extreme cases of X=0 md/ft and the case of X=00, the derivative profiles 90 and 92 are parallel to the time axis at later times during production (after hundreds of hours of flow). This is true for both pressure derivative and crossflow rate profiles for other values of specific permeability, X, shown in FIG. 5, which also stabilize to their respective plateaus at later production times.

For a non-zero value of the specific permeability (X=1.3e-7 md/ft, for example), the derivative profile 94 is similarly sloped as the derivative profile 92 for an infinite value of X following a period of transition along the derivative profile 90 for a zero value of X up to an elapsed time of 10,000 hr. Although this is an apparently important observation, actual pressure transient tests are usually run under 1,000 hr of elapsed time, and the recognition of the steepness of the derivative profile may not be easy to detect unless there exist high pressure differentials between the adjacent layers 14 and 16, causing substantial rates of crossflow between them. It can be observed that a plot of a derivative profile such as shown at 94 in a situation with crossflow between layers lies somewhere in between the two extreme cases of specific permeability described above. This is the hallmark signature of any crossflow between layers.

Figure 6:
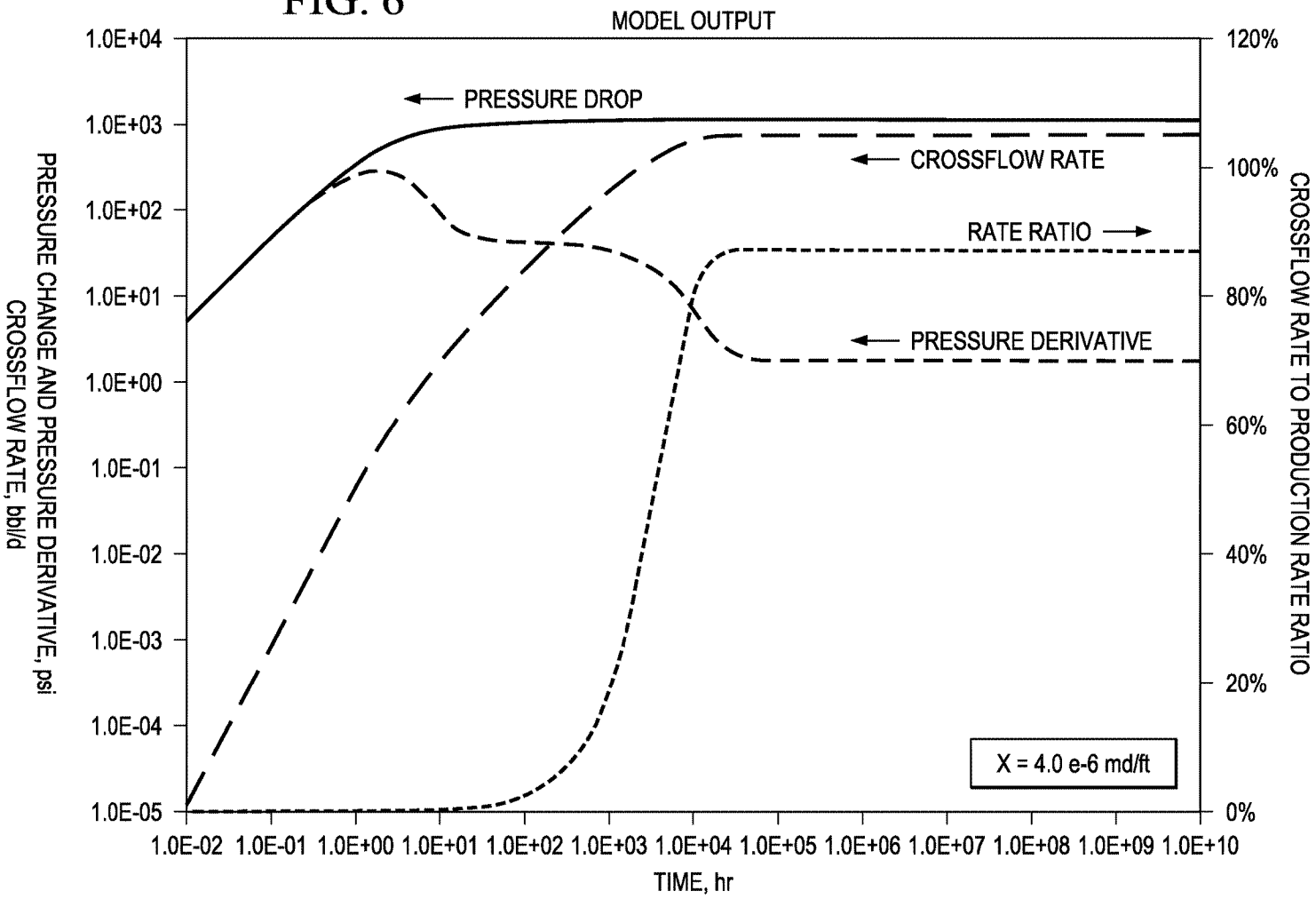
FIG. 6 is an example plot of data obtained from a case study measuring inter-reservoir cross flow rate between adjacent reservoir layers according to the present invention.

An example case study shows the output of the model parameters with a suitable specific permeability, X=4.0 e-6 md/ft for which the processing of FIG. 3 was performed. The output of this case study is shown in FIG. 6. The data plotted in FIG. 6 shows changes in well flowing pressures, pressure derivatives, crossflow rates and their relative crossflow rate to the total rate of production (as the ratio of crossflow rate to production rate expressed in percentage).

The data values in FIG. 6 are presented as a function of time. The time axis in FIG. 6 is presented on a logarithmic scale. The relative crossflow rate is presented on a linear, vertical scale axis on the right-hand side. The other model quantities are presented on a logarithmic scale axis on the left-hand side. The petrophysical, reservoir, fluid and well properties that have been input to the model for this case study are listed in Table 1. In this case, the effect of wellbore storage is apparent from the derivative profile up to 20 hr.

TABLE 1

| Input Parameters to Model | | | | |
|---|---|---|---|---|
| Layer 1 | Layer 2 | Streak | Fluid | Well |
| $k_1$ = 95 md<br>$k_{v1}$ = 7.6 md<br>$\phi_1$ = 0.18<br>$h_1$ = 12 ft<br>$c_{t1}$ = 3.0e−6/psi | $k_2$ = 270 md<br>$k_{v2}$ = 23.2 md<br>$\phi_2$ = 0.18<br>$h_2$ = 100 ft<br>$c_{t2}$ = 3.0e−6/psi | $k_{v0}$ = 0.0004 md<br>$h_0$ = 10 ft | $\mu$ = 0.75 cP<br>$B_o$ = 1.34 bbl/STB | C = 0.08 bbl/psi<br>q = 1,030 STB/d<br>$p_0$ = 3,000 psia<br>$s_1$ = +3<br>$r_{w1}$ = 0.3 ft<br>X = 4.0e−6 md/ft |

The present invention provides a systematic method to diagnose and quantify the crossflow between two adjacent layers in the reservoir from pressure transient-tests. The present invention also provides a systematic method to estimate time-dependent rates of crossflow from the adjacent layer to the active layer, from which a well is producing. Reservoir engineers are thus able to know the amounts of fluid migrating to or from a layer, and thus able to accomplish effective reservoir management. In addition, reserve estimates and voidage replacement during the production of hydrocarbons through water injection are also affected by the amounts of fluids lost or gained through crossflow. The present invention also assists reservoir professionals in these areas.

The present invention thus provides a methodology for estimating inter-layer crossflow rates from pressure transient-tests. The importance and benefits of estimating crossflow rates have been described. The present invention provides for estimation of the crossflow rates as a function of time through matching the data from pressure transient-tests. The methodology of the present invention also provides the ability to diagnose the existence of any crossflow between the two adjacent layers in the reservoir through comparison between the measured data from pressure transient tests and the model.

The invention has been sufficiently described so that a person with average knowledge in the field of reservoir modeling and simulation may reproduce and obtain the results mentioned in the invention herein. Nonetheless, any skilled person in the field of technique, subject of the invention herein, may carry out modifications not described in the request herein, to apply these modifications to a determined structure and methodology, or in the use and practice thereof, requires the claimed matter in the following claims; such structures and processes shall be covered within the scope of the invention.

It should be noted and understood that there can be improvements and modifications made of the present invention described in detail above without departing from the spirit or scope of the invention as set forth in the accompanying claims.

What is claimed is:

1. A computer implemented method of determining specific permeability of a semi-permeable formation between a producing formation layer of completed in a subsurface reservoir through a production casing string and an adjacent lower formation layer separated from the producing formation layer and the production casing string by the semi-permeable formation, the adjacent lower formation layer of the reservoir having a higher pressure than the producing formation layer during a pressure transient test of the producing formation layer, the computer implemented method comprising the steps of:

(a) obtaining a test measure of well pressure during the pressure transient test of the producing formation layer;

(b) determining a test pressure derivative of the test well pressure at sampled instants of measurement during the pressure transient test of the producing formation layer;

(c) receiving an estimated value of specific permeability of the semi-permeable formation between the producing formation layer and the adjacent lower formation layer;

(d) determining a model wellbore flowing pressure at the producing formation layer based on the test measure of well pressure and the estimated value of specific permeability of the semi-permeable formation;

(e) determining a model pressure derivative based on the test pressure derivative and the estimated value of specific permeability of the semi-permeable formation;

(f) determining a model inter-reservoir cross flow rate through the semi-permeable formation between the producing formation layer and the adjacent lower formation layer based on the received estimated value of specific permeability of the semi-permeable formation; and (g) if the estimated measures and test measures match within an acceptable degree of a preset criterion value:

(1) storing the estimated value of specific permeability of the semi-permeable formation as the determined specific permeability of the semi-permeable formation, the determined model inter-reservoir cross flow rate through the semi-permeable formation between the producing formation layer and the adjacent lower formation layer to the tested layer, the determined model wellbore flowing pressure, and the determined model pressure derivative; and (2) wherein the semi-permeable formation is located between the producing formation layer completed in the subsurface reservoir through the production casing string and the adjacent lower formation layer separated from the producing formation layer and the production casing string by the semi-permeable formation, with the adjacent lower formation layer of the reservoir having a higher pressure than the producing formation layer during the pressure transient test of the producing formation layer; and (3) forming an output record of the estimated value of specific permeability of the semi-permeable formation between the producing formation layer and the adjacent lower formation layer;

(h) and, if not:

(1) adjusting the value of specific permeability of the semi-permeable formation, and (2) wherein the semi-permeable formation is located between the producing formation layer completed in the subsurface reservoir through the production casing string and the adjacent lower formation layer separated from the producing formation layer and the production casing string by the semi-permeable formation, with the adjacent lower formation layer of the reservoir having a higher pressure than the producing formation layer during the pressure transient test of the producing formation layer, and (3) iteratively repeating the steps of determining a model wellbore flowing pressure, determining a model pressure derivative, and determining a model inter-reservoir cross flow rate from the adjacent layer to the producing formation layer based on the adjusted value of specific permeability of the semi-permeable formation until the estimated measures and test measures match within the acceptable degree of a preset criterion value.

2. The computer implemented method of claim 1, further including the step of forming an output display of the determined measure of the inter-reservoir cross flow rate through the semi-permeable formation between the producing formation layer and the adjacent lower formation layer.

3. The computer implemented method of claim 1, further including the step of forming an output display of the stored model wellbore flowing pressure.

4. The computer implemented method of claim 1, further including the step of forming an output display of the stored model pressure derivative.

5. The computer implemented method of claim 1, wherein the pressure transient testing is performed while the well is flowing for pressure drawdown.

6. The computer implemented method of claim 1, wherein the pressure transient testing is performed while the well is shut-in for pressure buildup.

7. The computer implemented of claim 1, wherein during step (g) the estimated measures and test measures match within an acceptable degree of a preset criterion value, and further including the step of:

storing the determined model inter-reservoir cross flow rate of step (f) as the measure of inter-reservoir cross flow rate through the semi-permeable formation.

8. A data processing system for determining specific permeability of a semi-permeable formation located between a producing formation layer completed in a subsurface reservoir through a production casing string and an adjacent lower formation layer separated from the producing formation layer and the production casing string by the semi-permeable formation, the adjacent lower formation layer having a higher pressure than the producing formation layer during a pressure transient test of the producing formation layer, the data processing system comprising:

a processor performing the steps of:

(a) obtaining a test measure of well pressure during the pressure transient test of the producing formation layer;

(b) determining a test pressure derivative of the test well pressure at sampled instants of measurement during the pressure transient test of the producing formation layer;

(c) receiving an estimated value of specific permeability of the semi-permeable formation between the producing formation layer and the adjacent lower formation layer;

(d) determining a model wellbore flowing pressure at the producing formation layer based on the test measure of well pressure and the estimated value of specific permeability of the semi-permeable formation;

(e) determining a model pressure derivative based on the test pressure derivative and the received estimated value of specific permeability of the semi-permeable formation;

(f) determining a model inter-reservoir cross flow rate through the semi-permeable formation between the producing formation layer and the adjacent lower formation layer based on the estimated value of specific permeability of the semi-permeable formation; and (g) if the estimated measures and test measures match within an acceptable degree of a preset criterion value:

(1) storing the estimated value of specific permeability of the semi-permeable formation as the determined specific permeability of the semi-permeable formation, the determined model inter-reservoir cross flow rate through the semi-permeable formation between the producing formation layer and the adjacent lower formation layer, the determined model wellbore flowing pressure, and the determined model pressure derivative; and (2) wherein the semi-permeable formation is located between the producing formation layer completed in the subsurface reservoir through the production casing string and the adjacent lower formation layer separated from the producing formation layer and the production casing string by the semi-permeable formation, with the adjacent lower formation layer of the reservoir having a higher pressure than the producing formation layer during the pressure transient test of the producing formation layer; and (h) and, if not, (1) adjusting the value of specific permeability of the semi-permeable formation, and (2) wherein the semi-permeable formation is located between the producing formation layer completed in the subsurface reservoir through the production casing string and the adjacent lower formation layer separated from the producing formation layer and the production casing string by the semi-permeable formation, with the adjacent lower formation layer of the reservoir having a higher pressure than the producing formation layer during the pressure transient test of the producing formation layer, and (3) iteratively repeating the steps of determining a model wellbore flow pressure, determining a model pressure derivative, and determining a model inter-reservoir cross flow rate through the semi-permeable formation between the producing formation layer and the adjacent lower formation layer based on the adjusted value of specific permeability of the semi-permeable formation until the estimated measures and test measures match within the acceptable degree of a preset criterion value;

a display forming an output record of the estimated value of specific permeability of the semi-permeable formation between the producing formation layer and the adjacent lower formation layer; and a memory storing the estimated value of specific permeability of the semi-permeable formation, the determined model pressure derivative, and the determined model inter-reservoir cross flow rate from the adjacent layer to the producing formation layer.

9. The data processing system of claim 8, further including:

an output display forming an output record of the determined measure of the inter-reservoir cross flow through the semi-permeable formation between the producing formation layer and the adjacent lower formation layer.

10. The data processing system of claim 8, further including:

the output display forming an output record of the stored model pressure derivative.

11. The data processing system of claim 8, further including:

the output display forming an output record of the stored model wellbore flowing pressure.

12. The data processing system of claim 8, wherein the estimated measures and test measures match within an acceptable degree of a preset criterion value, and the processor further performs the step of:

storing the determined model inter-reservoir cross flow rate of step (f) as the measure of inter-reservoir cross flow rate through the semi-permeable formation.

13. In pressure transient testing of a subsurface reservoir to evaluate productive capability of a producing formation layer completed in the reservoir through a production casing string, a method of forming a measure of inter-reservoir cross flow rate through a semi-permeable formation located between the producing formation layer and an adjacent lower formation layer, the semi-permeable formation layer separating the adjacent lower formation layer from the producing formation layer and production casing string, the adjacent lower formation layer having a higher pressure than the producing formation layer during a pressure transient test of the producing formation layer, the computer implemented method comprising the steps of:

(a) conducting a pressure transient test of the producing formation layer to obtain time and well pressure measurements as pressure transient test data of the producing formation layer;

(b) obtaining a test measure of well pressure during the pressure transient test of the producing formation layer;

(c) obtaining a test pressure derivative of well pressure at sampled instants of measurement during the pressure transient test of the producing formation layer;

(d) receiving an estimated value of specific permeability of the semi-permeable formation between the producing formation layer and the adjacent lower formation layer;

(e) determining a model wellbore flowing pressure of the producing formation layer based on the test measure of well pressure and the received estimated value of specific permeability of the semi-permeable formation between the producing formation layer and the adjacent lower formation layer;

(f) determining a model pressure derivative based on the test pressure derivative and the received estimated value of specific permeability of the semi-permeable formation between the producing formation layer and the adjacent lower formation layer;

(g) determining a model inter-reservoir cross flow rate through the semi-permeable formation based on the received estimated value of specific permeability of the semi-permeable formation between the producing formation layer and the adjacent lower formation layer; and (h) if the model measures and test measures match within an acceptable degree of a preset criterion value:

(1) storing the received estimated value of specific permeability of the semi-permeable formation as the determined specific permeability of the semi-permeable formation, the determined model inter-reservoir cross flow, the determined model wellbore flowing pressure of the producing formation layer, and the determined model pressure derivative; and (2) wherein the semi-permeable formation is located between the producing formation layer completed in the subsurface reservoir through the production casing string and the adjacent lower formation layer separated from the producing formation layer and the production casing string by the semi-permeable formation, with the adjacent lower formation layer of the reservoir having a higher pressure than the producing formation layer during the pressure transient test of the producing formation layer; and (3) determining the measure of the inter-reservoir cross flow rate through the semi-permeable formation between the producing formation layer and the adjacent lower formation layer based on the determined specific permeability of the semi-permeable formation;

(i) and, if not:

(1) adjusting the estimated value of specific permeability of the semi-permeable formation between the producing formation layer and the adjacent lower formation layer, and (2) wherein the semi-permeable formation is located between the producing formation layer completed in the subsurface reservoir through the production casing string and the adjacent lower formation layer separated from the producing formation layer and the production casing string by the semi-permeable formation, with the adjacent lower formation layer of the reservoir having a higher pressure than the producing formation layer during the pressure transient test of the producing formation layer, and (3) repeating the steps of determining a model wellbore flow pressure, determining a model pressure derivative, determining a model inter-reservoir cross flow rate through the semi-permeable formation, and comparing, based on the adjusted estimated value of specific permeability of the semi-permeable formation between the producing formation layer and the adjacent lower formation layer.

* * * * *